US009473859B2

(12) United States Patent
Burns et al.

(10) Patent No.: US 9,473,859 B2
(45) Date of Patent: Oct. 18, 2016

(54) SYSTEMS AND METHODS OF TELECOMMUNICATION FOR BILATERAL HEARING INSTRUMENTS

(71) Applicant: Starkey Laboratories, Inc., Eden Prairie, MN (US)

(72) Inventors: Thomas Howard Burns, St. Louis Park, MN (US); Michael Helgeson, New Richmond, WI (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 132 days.

(21) Appl. No.: 14/276,500

(22) Filed: May 13, 2014

(65) Prior Publication Data

US 2015/0334493 A1 Nov. 19, 2015

(51) Int. Cl.
*H04R 25/00* (2006.01)

(52) U.S. Cl.
CPC ..... *H04R 25/552* (2013.01); *H04R 25/456* (2013.01); *H04R 2225/021* (2013.01); *H04R 2225/023* (2013.01); *H04R 2225/025* (2013.01); *H04R 2225/55* (2013.01); *H04R 2460/13* (2013.01)

(58) Field of Classification Search
CPC ..... H04R 25/552
See application file for complete search history.

(56) References Cited

U.S. PATENT DOCUMENTS 4,598,585 A 7/1986 Boxenhorn et al.
5,091,952 A 2/1992 Williamson et al.
5,390,254 A 2/1995 Adelman
5,479,522 A 12/1995 Lindemann et al.
5,692,059 A 11/1997 Kruger
5,721,783 A 2/1998 Anderson
5,796,848 A 8/1998 Martin (Continued)

FOREIGN PATENT DOCUMENTS

EP 1063837 A2 12/2000
EP 0830802 B1 3/2008

(Continued)

OTHER PUBLICATIONS

"U.S. Appl. No. 12/233,356, Advisory Action mailed Oct. 12, 2012", 3 pgs.

(Continued)

*Primary Examiner* — Paul Huber
(74) *Attorney, Agent, or Firm* — Schwegman Lundberg & Woessner, P.A.

(57) ABSTRACT

Disclosed herein, among other things, are systems and methods for improved telecommunication for hearing instruments. One aspect of the present subject matter includes a hearing assistance method. The method includes receiving a first signal from a first hearing assistance device, receiving a second signal from a second hearing assistance device, and processing the first signal and the second signal to produce an output signal for use in telecommunication. In various embodiments, processing the first signal and the second signal includes comparing the first signal and the second signal, and selecting one or more of the first hearing assistance device and the second hearing assistance device for use in telecommunication based on the comparison. According to various embodiments, processing the first signal and the second signal includes combining the first signal and the second signal algorithmically to produce the output signal.

24 Claims, 3 Drawing Sheets

(56) References Cited

U.S. PATENT DOCUMENTS

| | | | | |
|---|---|---|---|---|
| 6,310,556 | B1 | 10/2001 | Green et al. | |
| 6,330,339 | B1 | 12/2001 | Ishige et al. | |
| 6,631,197 | B1 | 10/2003 | Taenzer | |
| 7,209,569 | B2 | 4/2007 | Boesen | |
| 7,289,639 | B2 | 10/2007 | Abel et al. | |
| 7,433,484 | B2 | 10/2008 | Asseily et al. | |
| 7,477,754 | B2 | 1/2009 | Rasmussen et al. | |
| 7,773,763 | B2 | 8/2010 | Pedersen | |
| 7,778,434 | B2 | 8/2010 | Juneau et al. | |
| 7,929,713 | B2 | 4/2011 | Victorian et al. | |
| 7,983,435 | B2 | 7/2011 | Moses | |
| 8,005,247 | B2 | 8/2011 | Westerkull | |
| 8,208,642 | B2 * | 6/2012 | Edwards | H04R 25/552 381/17 |
| 8,477,973 | B2 | 7/2013 | Merks | |
| 8,811,637 | B2 | 8/2014 | Burns et al. | |
| 9,294,849 | B2 | 3/2016 | Burns et al. | |
| 2001/0007050 | A1 | 7/2001 | Adelman | |
| 2004/0252852 | A1 * | 12/2004 | Taenzer | H04R 3/005 381/119 |
| 2005/0117764 | A1 * | 6/2005 | Arndt | H04R 25/43 381/315 |
| 2006/0029246 | A1 | 2/2006 | Boesen | |
| 2006/0159297 | A1 | 7/2006 | Wirola et al. | |
| 2006/0280320 | A1 | 12/2006 | Song et al. | |
| 2007/0036348 | A1 | 2/2007 | Orr | |
| 2007/0053536 | A1 | 3/2007 | Westerkull | |
| 2007/0167671 | A1 | 7/2007 | Miller | |
| 2008/0001780 | A1 | 1/2008 | Ohno et al. | |
| 2008/0175399 | A1 | 7/2008 | Kim et al. | |
| 2008/0205679 | A1 | 8/2008 | Darbut et al. | |
| 2009/0097681 | A1 | 4/2009 | Puria et al. | |
| 2009/0097683 | A1 | 4/2009 | Burns et al. | |
| 2010/0128907 | A1 * | 5/2010 | Dijkstra | H04R 25/407 381/315 |
| 2010/0172523 | A1 | 7/2010 | Burns et al. | |
| 2010/0172529 | A1 | 7/2010 | Burns et al. | |
| 2011/0158442 | A1 * | 6/2011 | Woods | H04R 25/552 381/317 |
| 2012/0183163 | A1 * | 7/2012 | Apfel | H04R 25/70 381/314 |
| 2013/0108058 | A1 | 5/2013 | Laurner et al. | |
| 2013/0343585 | A1 * | 12/2013 | Bennett | H04R 25/554 381/315 |
| 2015/0043761 | A1 | 2/2015 | Burns et al. | |

FOREIGN PATENT DOCUMENTS

| | | | |
|---|---|---|---|
| EP | 2123114 | A2 | 11/2009 |
| EP | 1519625 | B1 | 5/2010 |
| EP | 1657958 | B1 | 6/2012 |
| EP | 2040490 | B1 | 11/2012 |
| WO | WO-9845937 | A1 | 10/1998 |
| WO | WO-0057616 | A2 | 9/2000 |
| WO | WO-03073790 | A1 | 9/2003 |
| WO | WO-2004057909 | A2 | 7/2004 |
| WO | WO-2004092746 | A1 | 10/2004 |
| WO | WO-2006076531 | A2 | 7/2006 |
| WO | WO-2008138365 | A1 | 11/2008 |
| WO | WO-2010022456 | A1 | 3/2010 |

OTHER PUBLICATIONS

"U.S. Appl. No. 12/233,356, Final Office Action mailed May 31, 2012", 7 pgs.
"U.S. Appl. No. 12/233,356, Non Final Office Action mailed Jul. 2, 2013", 6 pgs.
"U.S. Appl. No. 12/233,356, Non Final Office Action mailed Oct. 25, 2011", 8 pgs.
"U.S. Appl. No. 12/233,356, Notice of Allowance mailed Feb. 20, 2014", 5 pgs.
"U.S. Appl. No. 12/233,356, Notice of Allowance mailed Oct. 29, 2013", 9 pgs.
"U.S. Appl. No. 12/233,356, Response filed Mar. 26, 2012 to Non Final Office Action mailed Oct. 25, 2011", 9 pgs.
"U.S. Appl. No. 12/233,356, Response filed Aug. 31, 2011 to Restriction Requirement mailed Aug. 18, 2011", 6 pgs.
"U.S. Appl. No. 12/233,356, Response filed Oct. 1, 2012 to Non Final Office Action mailed May 31, 2012", 8 pgs.
"U.S. Appl. No. 12/233,356, Response filed Oct. 2, 2013 to Non Final Office Action mailed Jul. 2, 2013", 8 pgs.
"U.S. Appl. No. 12/233,356, Restriction Requirement mailed Aug. 18, 2011", 6 pgs.
"U.S. Appl. No. 12/649,618 , Response filed Oct. 15, 2013 to Final Office Action mailed Aug. 15, 2013", 11 pgs.
"U.S. Appl. No. 12/649,618, Advisory Action mailed Oct. 2, 2012", 3 pgs.
"U.S. Appl. No. 12/649,618, Advisory Action mailed Oct. 28, 2013", 3 pgs.
"U.S. Appl. No. 12/649,618, Examiner Interview Summary mailed Dec. 27, 2013", 3 pgs.
"U.S. Appl. No. 12/649,618, Final Office Action mailed Jun. 14, 2012", 12 pgs.
"U.S. Appl. No. 12/649,618, Final Office Action mailed Aug. 15, 2013", 17 pgs.
"U.S. Appl. No. 12/649,618, Non Final Office Action mailed Jan. 28, 2014", 6 pgs.
"U.S. Appl. No. 12/649,618, Non Final Office Action mailed Nov. 14, 2011", 7 pgs.
"U.S. Appl. No. 12/649,618, Non Final Office Action mailed Dec. 14, 2012", 16 pgs.
"U.S. Appl. No. 12/649,618, Notice of Allowance mailed Apr. 22, 2014", 8 pgs.
"U.S. Appl. No. 12/649,618, Response filed Jan. 15, 2014 to Final Office Action mailed Aug. 15, 2013 and Advisory Action mailed Oct. 28, 2013", 8 pgs.
"U.S. Appl. No. 12/649,618, Response filed Apr. 14, 2014 to Non Final Office Action mailed Jan. 28, 2014", 6 pgs.
"U.S. Appl. No. 12/649,618, Response filed Apr. 16, 2012 to Non Final Office Action mailed Nov. 14, 2011", 6 pgs.
"U.S. Appl. No. 12/649,618, Response filed May 14, 2013 to Non Final Office Action mailed Dec. 14, 2012", 9 pgs.
"U.S. Appl. No. 12/649,618, Response filed Sep. 13, 2012 to Final Office Action mailed Jun. 14, 2012", 10 pgs.
"U.S. Appl. No. 12/649,634 , Response filed Oct. 15, 2013 to Final Office Action mailed Aug. 15, 2013", 11 pgs.
"U.S. Appl. No. 12/649,634, Advisory Action mailed Sep. 26, 2012", 3 pgs.
"U.S. Appl. No. 12/649,634, Advisory Action mailed Oct. 28, 2013", 3 pgs.
"U.S. Appl. No. 12/649,634, Examiner Interview Summary mailed Dec. 27, 2013", 3 pgs.
"U.S. Appl. No. 12/649,634, Final Office Action mailed Jun. 15, 2012", 13 pgs.
"U.S. Appl. No. 12/649,634, Final Office Action mailed Aug. 15, 2013", 18 pgs.
"U.S. Appl. No. 12/649,634, Non Final Office Action mailed Jan. 28, 2014", 6 pgs.
"U.S. Appl. No. 12/649,634, Non Final Office Action mailed Dec. 14, 2012", 18 pgs.
"U.S. Appl. No. 12/649,634, Non Final Office Action mailed Dec. 15, 2011", 10 pgs.
"U.S. Appl. No. 12/649,634, Response Flled Jan. 15, 2014 to Final Office Action mailed Aug. 15, 2013 and Advisory Action mailed Oct. 28, 2013", 9 pgs.
"U.S. Appl. No. 12/649,634, Response filed Apr. 14, 2014 to Non Final Office Action mailed Jan. 28, 2014", 6 pgs.
"U.S. Appl. No. 12/649,634, Response filed Apr. 16, 2012 to Non Final Office Action mailed Dec. 15, 2011", 8 pgs.
"U.S. Appl. No. 12/649,634, Response filed May 14, 2013 to Non Final Office Action mailed Dec. 14, 2012", 9 pgs.
"U.S. Appl. No. 12/649,634, Response filed Sep. 17, 2012 to Final Office Action mailed Jun. 15, 2012", 11 pgs.
"U.S. Appl. No. 14/462,043, Non Final Office Action mailed Nov. 28, 2014", 6 pgs.

(56) References Cited

OTHER PUBLICATIONS

"U.S. Appl. No. 14/462,043, Response filed Dec. 16, 2014 to Non Final Office Action mailed Nov. 28, 2014", 7 pgs.
"European Application Serial No. 08253052.8, Amendment filed Dec. 1, 2010", 14 pgs.
"European Application Serial No. 08253052.8, Extended European Search Report mailed May 6, 2010", 6 pgs.
"European Application Serial No. 08253052.8, Notice of Opposition mailed Aug. 6, 2013", w/English Translation, 48 pgs.
"European Application Serial No. 12191166.3, Extended European Search Report mailed Feb. 4, 2014", 8 pgs.
"European Application Serial No. 12191166.3, Partial European Search Report mailed Oct. 9, 2013", 5 pgs.
Kuk, F., et al., "Ampclusion Management 101: Understanding Variables", The Hearing Review, (Aug. 2002), 22-32.
Kuk, F., et al., "Ampclusion Management 102: A 5-Step Protocol", The Hearing Review, (Sep. 2002), 34-43.
"U.S. Appl. No. 14/462,043, Final Office Action mailed Apr. 28, 2015", 9 pgs.
"U.S. Appl. No. 14/462,043, Non Final Office Action mailed Jul. 21, 2015", 7 pgs.
"U.S. Appl. No. 14/462,043, Response filed Jun. 29, 2015 to Final Office Action mailed Apr. 28, 2015", 7 pgs.
"U.S. Appl. No. 14/462,043, Response filed Oct. 21, 2015 to Non Final Office Action mailed Jul. 21, 2015", 7 pgs.
"European Application Serial No. 15167496.7, Extended European Search Report mailed Aug. 28, 2015", 9 pgs.
"U.S. Appl. No. 14/462,043, Notice of Allowance mailed Nov. 9, 2015", 6 pgs.

* cited by examiner

SYSTEMS AND METHODS OF TELECOMMUNICATION FOR BILATERAL HEARING INSTRUMENTS

CROSS REFERENCE TO RELATED APPLICATIONS

This application is related to co-pending, commonly assigned, U.S. patent application Ser. No. 12/649,618, entitled "METHOD AND APPARATUS FOR DETECTING USER ACTIVITIES FROM WITHIN A HEARING ASSISTANCE DEVICE USING A VIBRATION SENSOR", filed on Dec. 30, 2009, which claims the benefit under 35 U.S.C. 119(e) of U.S. Provisional Patent Application Ser. No. 61/142,180 filed on Dec. 31, 2008, both of which are hereby incorporated by reference herein in their entirety.

TECHNICAL FIELD

This document relates generally to hearing systems and more particularly to systems, methods and apparatus for telecommunication with bilateral hearing instruments.

BACKGROUND

Hearing instruments, such as hearing assistance devices, are electronic instruments worn in or around the ear of a user or wearer. One example is a hearing aid that compensates for hearing losses of a hearing-impaired user by specially amplifying sound. Hearing aids typically include a housing or shell with internal components such as a signal processor, a microphone and a receiver housed in a receiver case. A hearing aid can function as a headset (or earset) for use with a mobile handheld device (MHD) such as a smartphone. However, current methods of telecommunication using hearing instruments can result in poor transmission quality and reduced speech intelligibility.

Accordingly, there is a need in the art for improved systems and methods of telecommunication for hearing instruments.

SUMMARY

Disclosed herein, among other things, are systems and methods for improved telecommunication for hearing instruments. One aspect of the present subject matter includes a hearing assistance method. The method includes receiving a first signal from a first hearing assistance device, receiving a second signal from a second hearing assistance device, and processing the first signal and the second signal to produce an output signal for use in telecommunication. In various embodiments, processing the first signal and the second signal includes comparing the first signal and the second signal, and selecting one or more of the first hearing assistance device and the second hearing assistance device for use in telecommunication based on the comparison. According to various embodiments, processing the first signal and the second signal includes combining the first signal and the second signal algorithmically to produce the output signal.

One aspect of the present subject matter includes a hearing assistance system. The system includes a first hearing assistance device including a first microphone and a first vibration sensor, a second hearing assistance device including a second microphone and a second vibration sensor, and a processor. The processor is configured to receive a first signal from the first hearing assistance device, the first signal including an indication of noise and gain of the first hearing assistance device and generated using information from the first microphone and the first vibration sensor. The processor is further configured to receive a second signal from the second hearing assistance device, the second signal including an indication of noise and gain of the second hearing assistance device and generated using information from the second microphone and the second vibration sensor. The processor is also configured to process the first signal and the second signal to produce an output signal for use in telecommunication. According to various embodiments, the processor is configured to compare the first signal and the second signal and to select one or more of the first hearing assistance device and the second hearing assistance device for use in telecommunication based on the comparison. The processor is configured to combine the first signal and the second signal algorithmically to produce the output signal, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
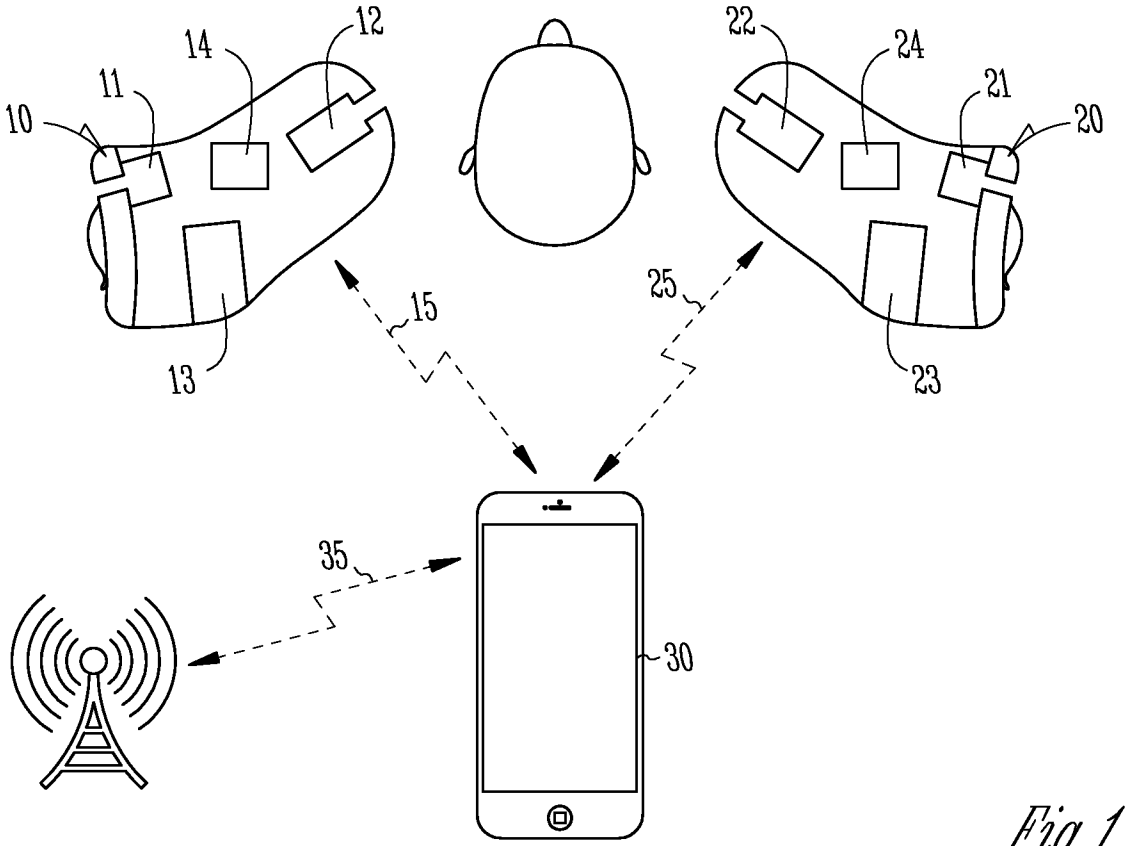
FIG. 1 illustrates an example of a system for telecommunication with bilateral hearing instruments, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing instruments and hearing assistance devices using the example of hearing aids. Hearing aids are only one type of hearing assistance device or hearing instrument. Other hearing assistance devices or hearing instruments include, but are not limited to, those in this document. It is understood that their use in the description is intended to demonstrate the present subject matter, but not in a limited or exclusive or exhaustive sense. One of skill in the art will understand that the present subject matter can be used for a variety of telecommunication applications, including but not limited to hearing assistance applications such as hearing instruments, personal communication devices and accessories.

Recently, efforts have been made to combine the functionality of wireless handheld devices with hearing aids. This new technology allows hearing aids to share wireless connectivity to mobile handheld devices (MHD) such as smartphones and tablets, thereby integrating bilateral hearing aids into hands-free, telecom applications where the aids function as a headset or earset.

For this document, the following normative references are used: 1) monaural listening involves the presentation of an audio stimulus to one ear alone, 2) diotic listening involves the simultaneous presentation of the same (monaural) stimulus to each ear, and 3) dichotic listening involves the simultaneous presentation of different stimuli to each ear. In addition, the present subject matter refers to 'full duplex' transmission for communications between MHD and hearing instruments, but this includes both simultaneous and near-simultaneous two-way communication herein. Furthermore, the term 'sidetones' in full-duplex applications refers to the process of amplifying and re-presenting a user's own voice at a very low level in their headset or earset to create a more-satisfying sense of aural unity in the conversation. Though the sidetone level is very low, it is audible to the user nonetheless and if absent, less desired.

In standard telecom headsets, a microphone is positioned on the housing or in a separate boom, often resulting in a bulky form factor. The microphone's output signal is transmitted to a single earphone of the end user's own headset, such that a monaural signal of the user's own voice is transmitted and amplified monaurally at the receiving end. Generally, an acoustically-closed earphone is employed in a standard headset, often causing discomfort over time.

In binaural telecom headsets, left and right earphones typically are tethered and only one earphone is equipped with a microphone and transceiver, such that only one earphone is considered an earset as defined by IEC 60268-7. This earset operates in full-duplex mode, thereby presenting the telecom signal monaurally through its earphone or diotically via the tether. There is a need, therefore, for binaural headsets that are small, wireless, capable of operating in noisy environments, and capable of dichotic presentation of signals.

Presently, hearing aids are becoming increasingly integrated into telecom applications for several reasons. First, in-the-ear (ITE) hearing aids are smaller and less obtrusive than headsets. Second, ITE aids usually are vented, thereby allowing more air circulation and reducing discomfort due to moistness and/or stickiness to the skin. The present subject matter includes bilateral hearing aids that can transmit two (left and right or L/R) own-voice signals to a MHD and since each aid acts as an earset as defined by IEC 60268-7, a dichotic signal can be presented to the user. Dichotic presentation does not imply that two full-duplex signals are transceived between the user's MHD and the caller on the other line, but rather a full-duplex signal is transmitted to each hearing aid, and each aid alters the signal locally and uniquely, thereby creating a dichotic presentation. Altering the signal locally may be needed if mechanical and/or acoustical feedback differs in each earset such that a digital feedback algorithm—operating independently in each earset—alters the L/R signals differently. Similarly, dichotic presentation can occur if each hearing aid earset presents its own unique sidetone signal as a mix between the microphone output and the full-duplex signal.

It should be noted that the in-situ motion of an ITE hearing aid due to body/tissue conduction during vocalization is typically hundreds of microns of displacement in the lower formant region of the voice and sub-micron displacements at the higher formants. A mechanical vibration sensor (MVS) mounted within the ITE and having the proper frequency sensitivity, is capable of picking up own-voice vibrations up to 3.5 kHz, thereby providing an own-voice telecom signal with an audio bandwidth that is intelligible and inherently immune to background acoustical noise, according to various embodiments.

The own-voice signal described in the present subject matter is not the output from a typical microphone, but rather the output signal(s) from a sensor, such as an MVS, located within the hearing aids. In various embodiments, the combining and switching of these signals is performed to provide the best full-duplex experience to both the user/wearer and the person on the other end of the telecommunication. As to the former, the output of each MVS, when compared to the playback level of the earset receiver in an adaptive feedback algorithm, can be used to determine the level of monaural or dichotic presentation and, when compared and/or combined with the output of the ITE microphone, the level of dichotic sidetones in various embodiments. As to the latter, the signal from the MVS with the best signal to noise ratio (SNR) is transmitted, in various embodiments.

In full-duplex mode, for example, the MVS is susceptible to vibrations from the hearing aid receiver, thereby causing a condition for mechanical echo to the person on the other line. If a user is in a noisy environment and the preferred listening level (PLL) is increased, the primary concern is no longer acoustical feedback but rather mechanical feedback, particularly for users with severe hearing loss. The present subject matter maximizes mechanical gain before feedback and thereby alters the PLL of each hearing aid independently, since each aid will have its own unique mechanical feedback path and audiogram. In various embodiments, a digital signal processing (DSP) method determines the better signal for transmission, toggles between the L/R signals if the ambient noise conditions change, and adjusts the sidetones and the PLL as needed. Thus, a diotic signal—altered by independent mechanical feedback cancelation algorithms and unique L/R sidetones—becomes dichotic.

If sidetone methods are employed using the microphones of bilateral hearing aids, earmold vents may exacerbate the potential for acoustical feedback, particularly if a digital feedback reducer is not active. The present subject matter provides a DSP method to compare the bilateral microphone signals and to choose the signal with less ambient noise and less acoustical feedback, and furthermore, to toggle between these microphone signals if the ambient boundary conditions change such that one microphone signal becomes better than the other. Each independent L/R sidetone signal, when mixed with the duplex signal, creates a dichotic experience in various embodiments.

Disclosed herein, among other things, are systems and methods for improved telecommunication for hearing instruments. One aspect of the present subject matter includes a hearing assistance method. The method includes receiving a first signal from a first hearing assistance device, receiving a second signal from a second hearing assistance device, and processing the first signal and the second signal to produce an output signal for use in telecommunication. In various embodiments, processing the first signal and the second signal includes comparing the first signal and the second signal, and selecting one or more of the first hearing assistance device and the second hearing assistance device for use in telecommunication based on the comparison.

According to various embodiments, processing the first signal and the second signal includes combining the first signal and the second signal algorithmically to produce the output signal. Multiple signals/sources can be combined programmably to obtain the output signal, in various embodiments. In various embodiments, the first and second signals include power spectral estimates of ambient noise from microphones of the first and second hearing assistance device. The first and second signals include open loop gain between the receivers and vibration sensors of the first and second hearing assistance device, in various embodiments. The first signal and second signals includes open loop gain between the microphones and receivers of the first and second hearing assistance device, according to various embodiments.

One aspect of the present subject matter includes a hearing assistance system. The system includes a first hearing assistance device including a first microphone and a first vibration sensor, a second hearing assistance device including a second microphone and a second vibration sensor, and a processor. The processor is configured to receive a first signal from the first hearing assistance device, the first signal including an indication of noise and gain of the first hearing assistance device and generated using information from the first microphone and the first vibration sensor. The processor is further configured to receive a second signal from the second hearing assistance device, the second signal including an indication of noise and gain of the second hearing assistance device and generated using information from the second microphone and the second vibration sensor. The processor is also configured to process the first signal and the second signal to produce an output signal for use in telecommunication. According to various embodiments, the processor is configured to compare the first signal and the second signal and to select one or more of the first hearing assistance device and the second hearing assistance device for use in telecommunication based on the comparison. The processor is configured to combine the first signal and the second signal algorithmically to produce the output signal, in various embodiments. In various embodiments, the processor is in the first hearing assistance device. In various embodiments, the processor is in the second hearing assistance device. In various embodiments, the processor is in an external device. Various embodiments include portions of the processor in one or both of the hearing assistance devices and the external device.

Thus, in one embodiment, the present subject matter integrates bilateral hearing aids into telecom applications by evaluating both (bilateral) own-voice signals, choosing the better signal of the two (or combining the two to produce a new output signal), and transmitting it to the end user, and choosing the best way to manage sidetones and present a monaural, diotic, or dichotic signal to the user. In a further embodiment, multiple signals/sources can be combined programmably to obtain the output signal, in various embodiments. The programmable combination includes intelligent (or algorithmic) combination of signals from a microphone and MVS within a hearing aid, a mobile device or an intermediate device for best audio clarity and performance, in various embodiments. Thus, various embodiments compare and select to obtain an output signal, and other embodiments process multiple sources to obtain an output signal, and thereby improve audio quality through algorithmic combination. While the present subject matter discusses hearing instruments and hearing assistance devices using the example of ITE hearing aids, ITE hearing aids are only one type of hearing assistance device or hearing instrument. Other hearing assistance devices or hearing instruments may be used, including but not limited to those enumerated in this document.

FIG. 1 illustrates an example of a system for telecommunication with bilateral hearing instruments, according to various embodiments of the present subject matter. A left ITE 10 includes faceplate microphone 11, earphone receiver 12, MVS 13, DSP 14, and transmits a full-duplex signal 15 to MHD 30, in various embodiments. Similarly, a right ITE 20 includes faceplate microphone 21, earphone receiver 22, MVS 23, digital signal processor 24, and also transmits full-duplex signal 25 to MHD 30. Digital signal processor 14 computes power spectral estimates of ambient noise from faceplate microphone 11, open loop gain between earphone receiver 12 and MVS 13, and open loop gain between faceplate microphone 11 and earphone receiver 12, in various embodiments. Low-level information about these gains is embedded in left ITE 10 transmission of full-duplex 15 to MHD 30, in various embodiments. Similarly, digital signal processor 24 computes power spectral estimates of ambient noise from faceplate microphone 21, open loop gain between earphone receiver 22 and MVS 23, and open loop gain between faceplate microphone 21 and earphone receiver 22, in various embodiments. In various embodiments, low-level information about these gains is embedded in right ITE 20 transmission of full-duplex 25 to MHD 30. In various embodiments, signal processing on MHD 30 compares the L/R information and chooses the better audio signal for wireless transmission 35 to the mobile provider, and also shares low-level information between left ITE 10 and right ITE 20 thereby controlling each ITE to present a monaural, diotic or dichotic signal to the user. For example, if low-level information indicates that one ITE has poor gain and a poor MVS signal, monaural playback may be preferred in one ear alone. If, on the other hand, the low-level information indicates that all gains are sufficient and ambient noise is low, sidetones can be presented equally for a diotic playback signal. Lastly, if the low-level information indicates that one ear has a gain advantage over the other and/or ambient noise levels are uneven at each faceplate microphone, dichotic playback may be advantageous using different sidetones and/or or different acoustical noise management algorithms in each ITE. In various embodiments, the L/R information is combined algorithmically to produce the output signal.

Figure 2:
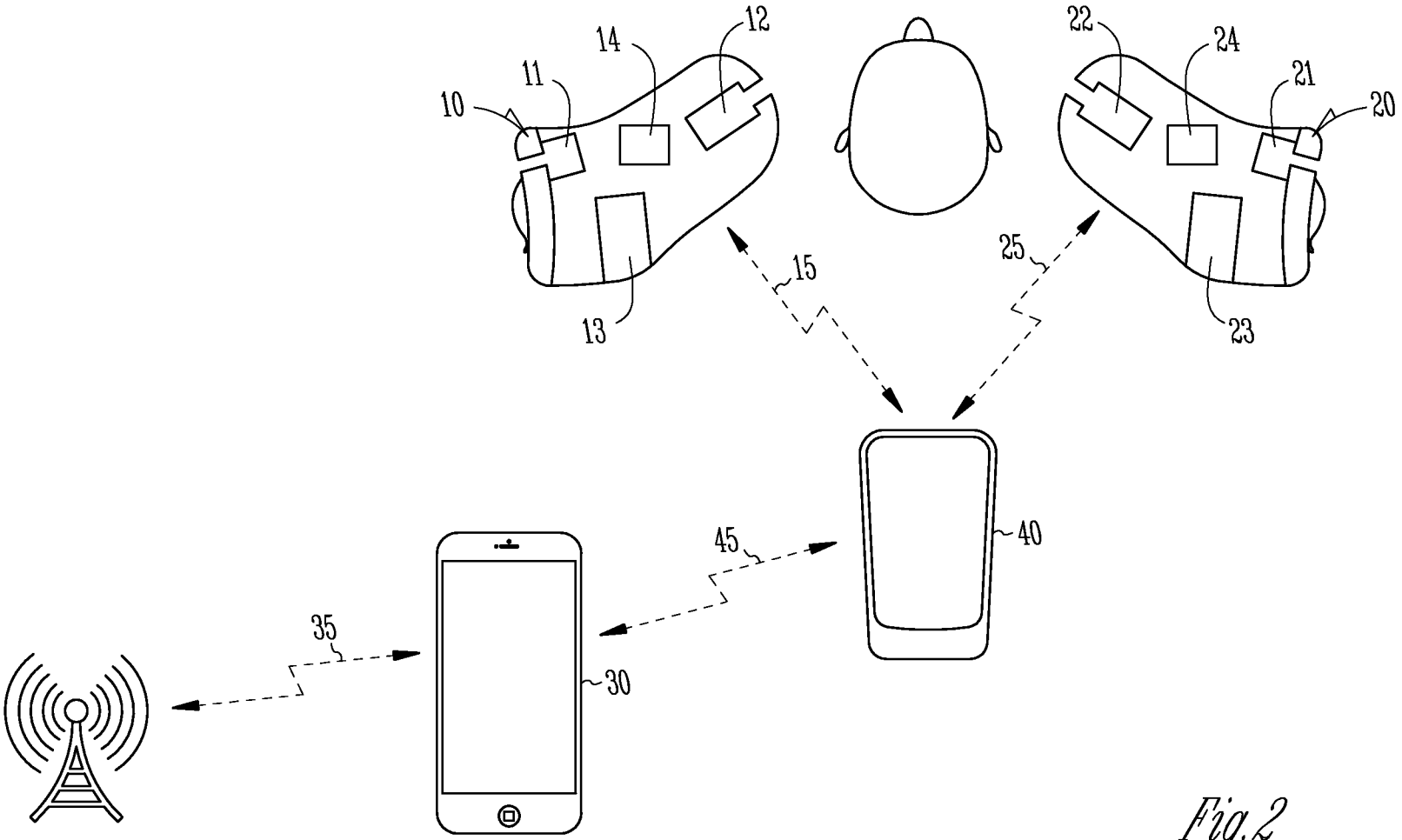
FIG. 2 illustrates an example of a system including a separate wireless transceiver for telecommunication with bilateral hearing instruments, according to various embodiments of the present subject matter.

FIG. 2 illustrates an example of a system including a separate wireless transceiver for telecommunication with bilateral hearing instruments, according to various embodiments of the present subject matter. This embodiment performs the same overall functionality as the embodiment of FIG. 1, except that a full-duplex wireless transceiver 40 is active between hearing aids 10, 20 and MHD 30. In this configuration, a proprietary wireless protocol such as Bluetooth Low Energy or inductive coupling can be used between aids 10, 20 and transceiver 40 while a standard protocol such as Bluetooth can be used between transceiver 40 and MHD 30. In this embodiment, transceiver 40 includes a signal processing core configured to process the L/R information received from aids 10, 20, thereby producing a better audio signal for wireless transmission (45) to MHD (30).

Additional embodiments can further minimize or reduce latency. For example, hearing aid 10 can eavesdrop on signal stream 25 sent from hearing aid 20 to MHD 30 or transceiver 40, and hearing aid 20 can eavesdrop on signal stream 15 being set from HA 10. This embodiment eliminates the need for MHD 30 or transceiver 40 to process and relay processed sidetones back to hearing aids 10 and 20. In various embodiments, signals 15 and 25 can consist of independent audio data from faceplate microphones and MVS for processing by MHD 30 and transceiver 40. This provides two audio sources from each hearing aid 10 and 20, which can also be combined or enhanced with microphone sources within MHD 30 and/or transceiver 40 to produce the best or most enhanced/intelligible audio sent over wireless transmission 35 to a far-end user, in various embodiments. In various embodiments, this combination or enhancement is referred to as algorithmic processing. According to various embodiments, the faceplate microphone 11, 21 and MVS 13, 23 can be combined locally within hearing aids 10 and 20.

Figure 3:
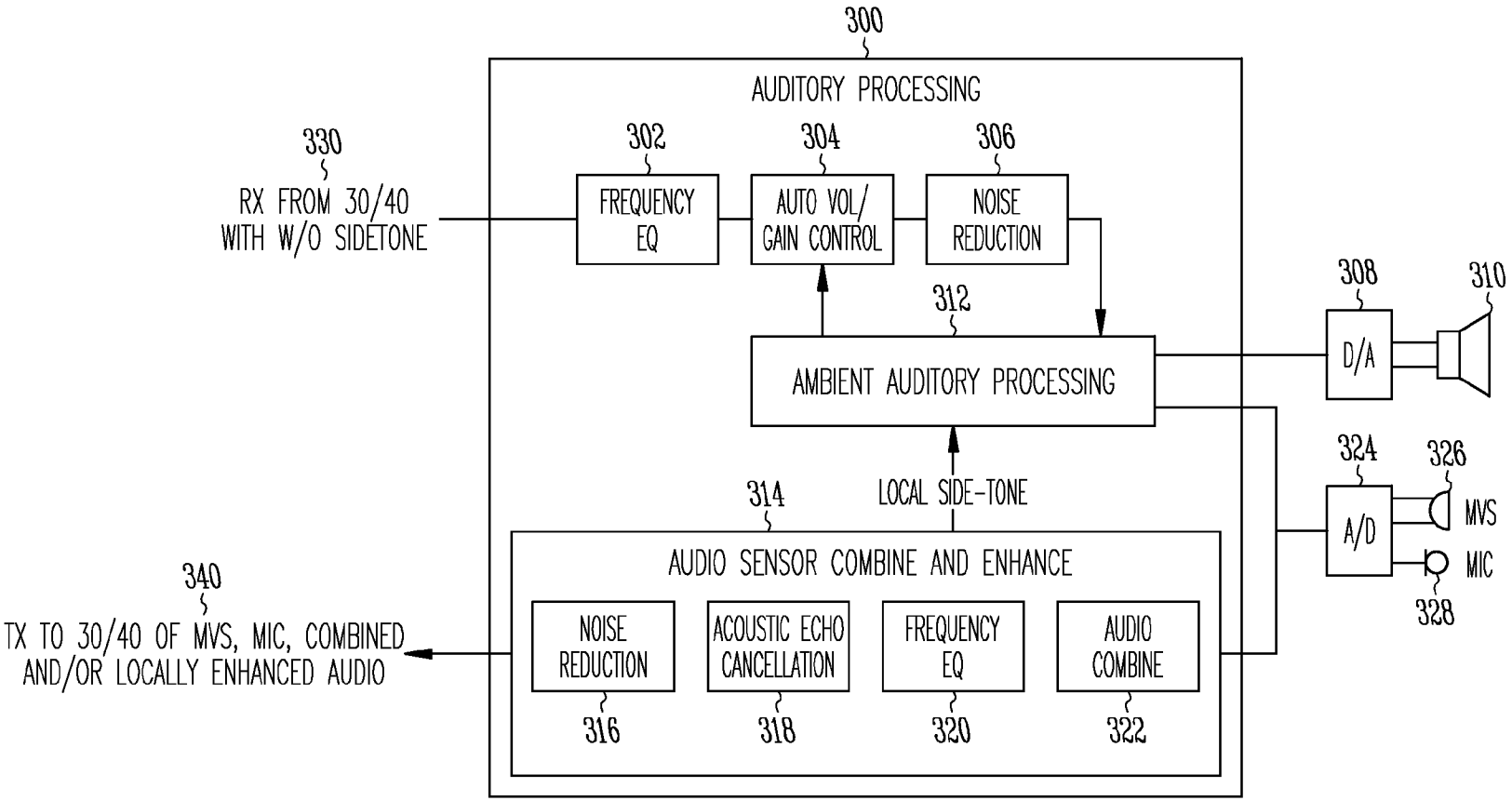
FIG. 3 illustrates a schematic diagram of a hearing instrument for telecommunication, according to various embodiments of the present subject matter.

FIG. 3 illustrates a schematic diagram of a hearing instrument for telecommunication, according to various embodiments of the present subject matter. The depicted embodiment provides local processing in a hearing instrument of the microphone and MVS to generate the sidetone that can be sent individually, or combined. The instrument includes a microphone 328, MVS 326 and receiver 310, in various embodiments. Auditory processing module 300 interfaces with the receiver 310 via D/A converter 308, and interfaces with the microphone 328 and MVS 326 via A/D converter 324, in various embodiments. According to various embodiments, the auditory processing module includes a frequency equalizer 302 for receiving a signal 330 from external devices and an audio sensor enhancement module 314 to transmit a signal 340 to external devices. The module 300 further includes gain control 304, noise reduction 306, ambient auditory processing 312, noise reduction 316, acoustic echo cancellation 318, frequency equalizer 320 and audio combining module 322, according to various embodiments. In various embodiments, there are many forms of processing which can be done on these audio sensor streams locally prior to sending. In various embodiments, hearing aids 10 and 20 communicate directly with each other outside of signal streams 15 and 25. This eliminates the need for MHD 30 or transceiver 40 to process sidetone and relay back to hearing aids 10 and 20.

The systems and methods of the present subject matter provide ways to evaluate the quality of a user's own voice for transmission and sidetone presentation in bilateral hearing aid telecommunications applications. Various embodiments of the present subject matter use the bilateral hearing aids as two individual earsets, evaluate the own-voice signal to determine which of the two is better, present it as a monaural, diotic, or dichotic signal to the user, and transmit the better own-voice signal to the person on the outside line. In various embodiments, the two are combined to produce an output signal. Thus, the present subject matter transmits an own-voice signal with higher signal to ambient noise and less acoustical feedback so that the receiving telecommunication user can perceive higher speech intelligibility. In contrast, typical binaural telecom headsets only have one earset, and consequently, only one own-voice signal to work with, limiting the signal quality. Besides hearing assistance devices, the present subject matter can be applied to any type of two-ear headset, such as in internet gaming applications for example.

It is understood that variations in combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the user.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), invisible-in-canal (IIC) or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method, comprising:

receiving a first signal from a first hearing assistance device, the first signal including an indication of noise and gain of the first hearing assistance device and generated using information from a first microphone and a first vibration sensor of the first hearing assistance device;

receiving a second signal from a second hearing assistance device, the second signal including an indication of noise and gain of the second hearing assistance device and generated using information from a second microphone and a second vibration sensor of the second hearing assistance device; and processing the first signal and the second signal, including comparing own voice signals from the first and second hearing assistance device and using the comparison to control processing of the first and second signals to produce an output signal for use in telecommunication.

2. The method of claim 1, wherein processing the first signal and the second signal includes:

comparing the first signal and the second signal; and selecting one or more of the first hearing assistance device and the second hearing assistance device for use in telecommunication based on the comparison.

3. The method of claim 1, wherein processing the first signal and the second signal includes combining the first signal and the second signal algorithmically to produce the output signal.

4. The method of claim 1, wherein the first signal includes a power spectral estimate of ambient noise from the first microphone.

5. The method of claim 1, wherein the first hearing assistance device includes a first receiver, and wherein the first signal includes an open loop gain between the first receiver and the first vibration sensor.

6. The method of claim 5, wherein the first signal includes an open loop gain between the first microphone and the first receiver.

7. The method of claim 1, wherein the first vibration sensor includes a mechanical vibration sensor (MVS).

8. The method of claim 1, wherein the second signal includes a power spectral estimate of ambient noise from the second microphone.

9. The method of claim 1, wherein the second hearing assistance device includes a second receiver, and wherein the second signal includes an open loop gain between the second receiver and the second vibration sensor.

10. The method of claim 9, wherein the second signal includes an open loop gain between the second microphone and the second receiver.

11. The method of claim 1, wherein the second vibration sensor includes a mechanical vibration sensor (MVS).

12. The method of claim 2, wherein selecting one or more of the first hearing assistance device and the second hearing assistance device for use in telecommunication includes using one or more of a monaural, diotic or dichotic signal.

13. A hearing assistance system, comprising:

a first hearing assistance device including a first microphone and a first vibration sensor;

a second hearing assistance device including a second microphone and a second vibration sensor;

a processor configured to:

receive a first signal from the first hearing assistance device, the first signal including an indication of noise and gain of the first hearing assistance device and generated using information from the first microphone and the first vibration sensor;

receive a second signal from the second hearing assistance device, the second signal including an indication of noise and gain of the second hearing assistance device and generated using information from the second microphone and the second vibration sensor; and process the first signal and the second signal, including comparing own voice signals from the first and second hearing assistance device and using the comparison to control processing of the first and second signals to produce an output signal for use in telecommunication.

14. The system of claim 13, wherein the processor is configured to:

compare the first signal and the second signal; and select one or more of the first hearing assistance device and the second hearing assistance device for use in telecommunication based on the comparison.

15. The system of claim 13, wherein the processor is configured to combine the first signal and the second signal algorithmically to produce the output signal.

16. The system of claim 13, wherein the processor includes a digital signal processor (DSP).

17. The system of claim 13, wherein at least one of the first hearing assistance device and the second hearing assistance device includes a hearing aid.

18. The system of claim 17, wherein the hearing aid includes an in-the-ear (ITE) hearing aid.

19. The system of claim 17, wherein the hearing aid includes a behind-the-ear (BTE) hearing aid.

20. The system of claim 17, wherein the hearing aid includes an in-the-canal (ITC) hearing aid.

21. The system of claim 17, wherein the hearing aid includes a receiver-in-canal (RIC) hearing aid.

22. The system of claim 17, wherein the hearing aid includes a completely-in-the-canal (CIC) hearing aid.

23. The system of claim 17, wherein the hearing aid includes a receiver-in-the-ear (RITE) hearing aid.

24. The system of claim 17, wherein the hearing aid includes an invisible-in-canal (IIC) hearing aid.

* * * * *